US007490504B1

(12) United States Patent
Hirsch et al.

(10) Patent No.: US 7,490,504 B1
(45) Date of Patent: Feb. 17, 2009

(54) COMBINED COUPLING AND CRIMPING/SPLICING TOOL

(76) Inventors: Albert L. Hirsch, 19343 Olivos Dr., Tarzana, CA (US) 91356; Harold Perla, 18324 Clark St., Tarzana, CA (US) 91356

( * ) Notice: Subject to any disclaimer, the term of this patent is extended or adjusted under 35 U.S.C. 154(b) by 49 days.

(21) Appl. No.: 11/393,938

(22) Filed: Mar. 31, 2006

(51) Int. Cl.
*B25B 7/00* (2006.01)

(52) U.S. Cl. ..... 72/409.01; 72/409.19

(58) Field of Classification Search ..... 72/409.19, 72/409.01, 416; 29/751, 758, 749, 761, 753; 81/426.5, 427.5, 417
See application file for complete search history.

(56) References Cited

U.S. PATENT DOCUMENTS

| | | | | | |
|---|---|---|---|---|---|
| 464,860 | A | * | 12/1891 | Duvall | 81/417 |
| 1,926,197 | A | | 9/1933 | Durr | |
| 1,955,695 | A | * | 4/1934 | Veling | 439/878 |
| 1,966,593 | A | * | 7/1934 | O'Russa | 140/118 |
| 2,881,649 | A | * | 4/1959 | Ball et al. | 81/339 |
| 3,590,108 | A | * | 6/1971 | Startin | 264/150 |
| 3,625,350 | A | * | 12/1971 | Ray | 206/713 |
| 3,769,704 | A | * | 11/1973 | Abarotin et al. | 29/871 |
| 4,065,637 | A | * | 12/1977 | Allison | 174/87 |
| 4,077,695 | A | * | 3/1978 | Bakermans | 439/499 |
| 4,912,958 | A | * | 4/1990 | Yonkers | 72/409.01 |
| 5,186,648 | A | * | 2/1993 | Senra | 439/409 |
| 5,217,392 | A | | 6/1993 | Hosler, Sr. | |
| 5,520,974 | A | | 5/1996 | Chiotis et al. | |
| 5,783,778 | A | | 7/1998 | Foss et al. | |
| 5,854,444 | A | | 12/1998 | Fehlhaber | |
| 6,100,472 | A | | 8/2000 | Foss | |
| D496,000 | S | | 9/2004 | Cornell | |

* cited by examiner

*Primary Examiner*—Dana Ross
*Assistant Examiner*—Debra M Wolfe

(57) ABSTRACT

A connector and crimping/splicing tool includes a connector that has tubular sleeves monolithically formed with each other and registered in parallel. Each sleeve has an outer casing, a conductive inner casing mated to the outer casing, and conductive knurls protruding towards the sleeve center. A tool includes first and second jaws and first and second handles monolithically formed therewith. A mechanism is included for articulating the handles to an equilibrium position after the jaws are pivoted to an open position. The resilient articulating mechanism includes a helical spring that has opposed ends conjoined to the first and second handles. The connector is intercalated between the jaws such that a first set of wires can be inserted from one connector end while a second set of wires is inserted through another connector end, thereby allowing the jaws to crush the sleeves and bridge a conductive path therebetween.

6 Claims, 5 Drawing Sheets

COMBINED COUPLING AND CRIMPING/SPLICING TOOL

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to combination tools and, more particularly, to a combined coupling and crimping/splicing tool for coupling non-metallic sheathed cable.

2. Prior Art

A wide variety of substrates require protection from adverse environmental conditions such as moisture, insects, plant life, and corrosion deposits. For some substrates such as electrical components, it is desirable that a protective cove or material be provided such that it is possible to easily reenter and work on the substrate, for the purpose of re-splicing, repairing, etc. It is known to protect an electrical contact with grease, the grease being contained in a container which is applied to the electrical contact. However, grease is limited in the ways that it can be used. Furthermore, when reentry is attempted, the grease remains on the contact when the container is removed and must be cleaned off before electrical work can begin.

Electrical contacts can also be potted or encapsulated in a container with a two-part liquid composition prepared by mixing ingredients which will slowly react together. Before the ingredients have reacted and cured, the mixture is poured into the container, where it cures around the contacts into an encapsulating composition. However, this procedure entails preparation of the liquid composition at the work site, waiting while the composition cures, and the provision of a container around the contacts, into which the composition can be poured and allowed to cure. Furthermore, when reentry is required, the cured composition cannot be easily removed.

A further method of splicing together wires calls for using crimp center conductors for splicing together the center conductors. A shield braid sleeve is used to provide a shielding effect for the splice. Solder sleeves are soldered to each end of the wire to provided braid to braid connections for electrical continuity. Heat shrink tubing is placed around the spliced area for environmentally sealing the spliced shielded wire. When splicing together wires using current kits and methods, the following tools are required: cable prep hand tools, crimp tools, and a heat gun for soldering sleeves and shrinking boots. While present kits and methods do work for splicing together wires, they have one main problem. Present kits and methods require a heat gun for melting the solder and shrinking the heat shrink tubing. The heat gun requirement makes present kits and methods unsafe and time consuming for use in repairing damaged wires.

Accordingly, a need remains for a combined coupling and crimping/splicing tool in order to overcome the above-noted shortcomings. The present invention satisfies such a need by providing a combined coupling and crimping/splicing tool that is convenient and easy to use, small and light weight in construction, and is simple and easy to install. Such a combined tool can be used for creating splices in a matter of minutes, if not seconds. It effectively eliminates the need for a junction box thereby reducing costs and the need to mar the appearance of a wall or ceiling with a cover plate.

BRIEF SUMMARY OF THE INVENTION

In view of the foregoing background, it is therefore an object of the present invention to provide a combined coupling and crimping/splicing tool. These and other objects, features, and advantages of the invention are provided by a combined connector and crimping/splicing tool for coupling non-metallic sheathed cable.

The combined connector and crimping/splicing tool includes a connector including a plurality of coextensively shaped hollow tubular sleeves monolithically formed with each other such that the tubular sleeves remain statically affixed during operating conditions. Each of the tubular sleeves has a uniform and continuous outer casing directly coupled to an adjacent one of the outer casings in such a manner that the tubular sleeves are registered parallel to each other.

Each of the tubular sleeves further includes a conductive inner casing directly mated to an interior surface of a corresponding one of the outer casings respectively. Such inner and outer casings of the sleeves preferably are collapsible. Each of the inner casings is provided with a plurality of conductive, sharp knurls radially protruding inwardly towards a center of the tubular sleeves respectively. Such conductive knurls may be equidistantly spaced along an inner perimeter of the inner sleeves and uniformly engage the first and second sets of wires as the first and second jaws are compressed to the closed position.

A hand-operated tool includes first and second jaws, wherein the first and second jaw members are coextensively shaped. Each of the first and second jaws preferably includes a plurality of blunted arcuate cavities oppositely and equidistantly offset from respective inner edges of the first and second jaws such that a first set of the blunted arcuate cavities faces a corresponding second set of the blunted arcuate cavities in such a manner that each of the outer casings becomes interfitted between the first and second sets of the blunted arcuate cavities when the first and second jaws are pivoted to the closed position. Such first and second sets of the blunted arcuate cavities may be coextensively shaped. First and second handles are monolithically formed with the first and second jaws. Such first and second handles are spaced apart when the first and second jaws are directly abutted at an engaged position.

A mechanism is included for resiliently articulating the first and second handles to an equilibrium position after the first and second jaws are pivoted to an open position. Such a resilient articulating mechanism creates a resistive force opposing a disengaging movement of the first and second jaws. The resilient articulating mechanism includes a single and unitary helical spring member that has axially opposed end portions directly conjoined to an interior surface of each of the first and second handles respectively. Such a helical spring member is compressed when the first and second jaws are pivoted to the open position. The helical spring member returns to equilibrium when the first and second jaws are pivoted to the closed position.

The connector is statically intercalated directly between the first and second jaws when the first and second jaws are pivoted to a closed position such that a first set of wires can be telescopically inserted from a first end of the connector while a second set of wires can be telescopically inserted through a second end of the connector and thereby effectively allow the first and second jaws to crush the sleeves directly about the first and second set of wires such that the conductive knurls bridge a conductive path between the first and second set of wires respectively. Such a connector may have a longitudinal length traversing through the first and second jaw members during crimping procedures.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
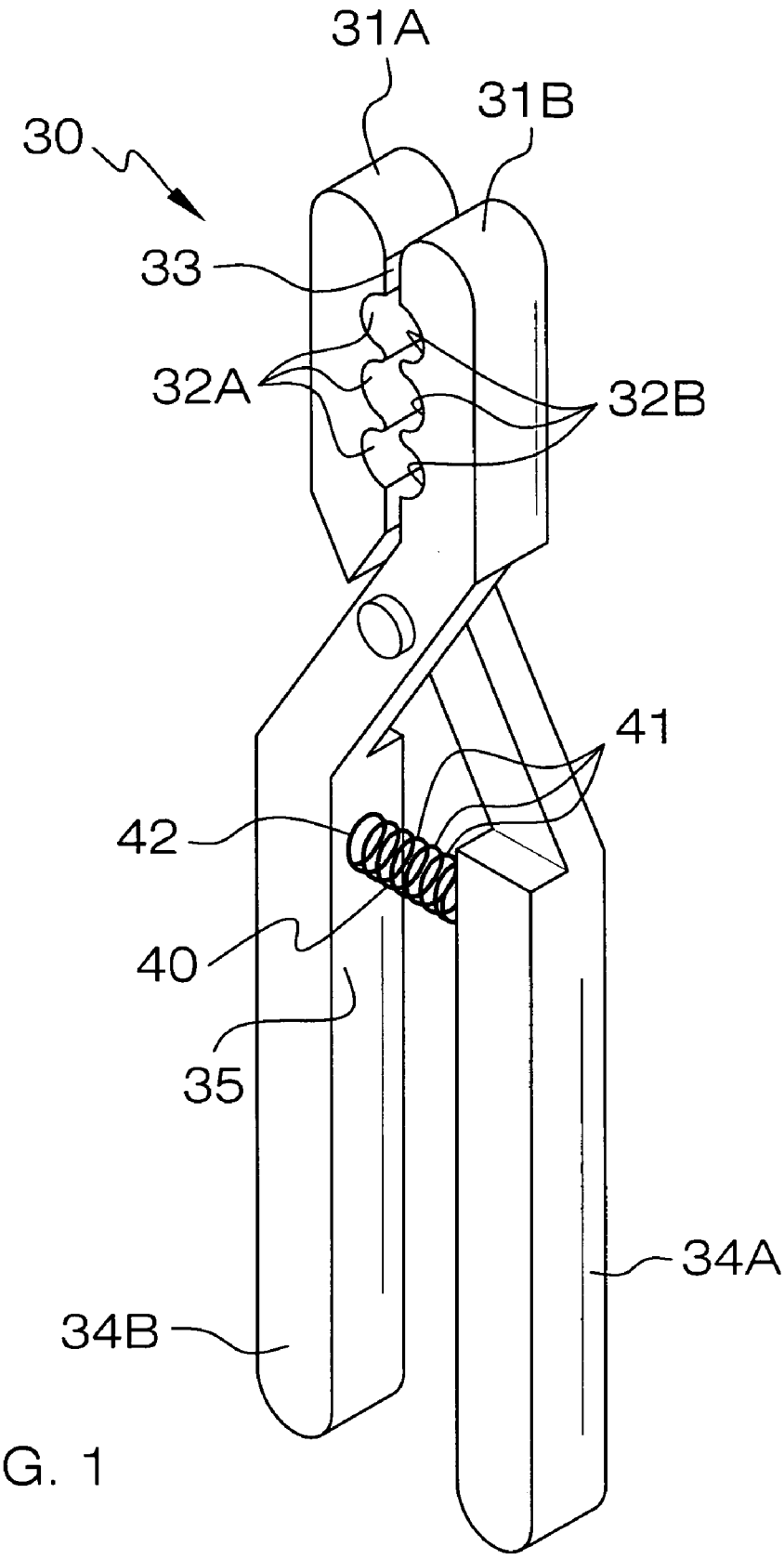
FIG. 1 is a perspective view showing a hand operated tool, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to provide a combined coupling and crimping/splicing tool. It should be understood that the apparatus 10 may be used to splice many different types of conductive wires and should not be limited in use to only installation applications.

Figure 2:
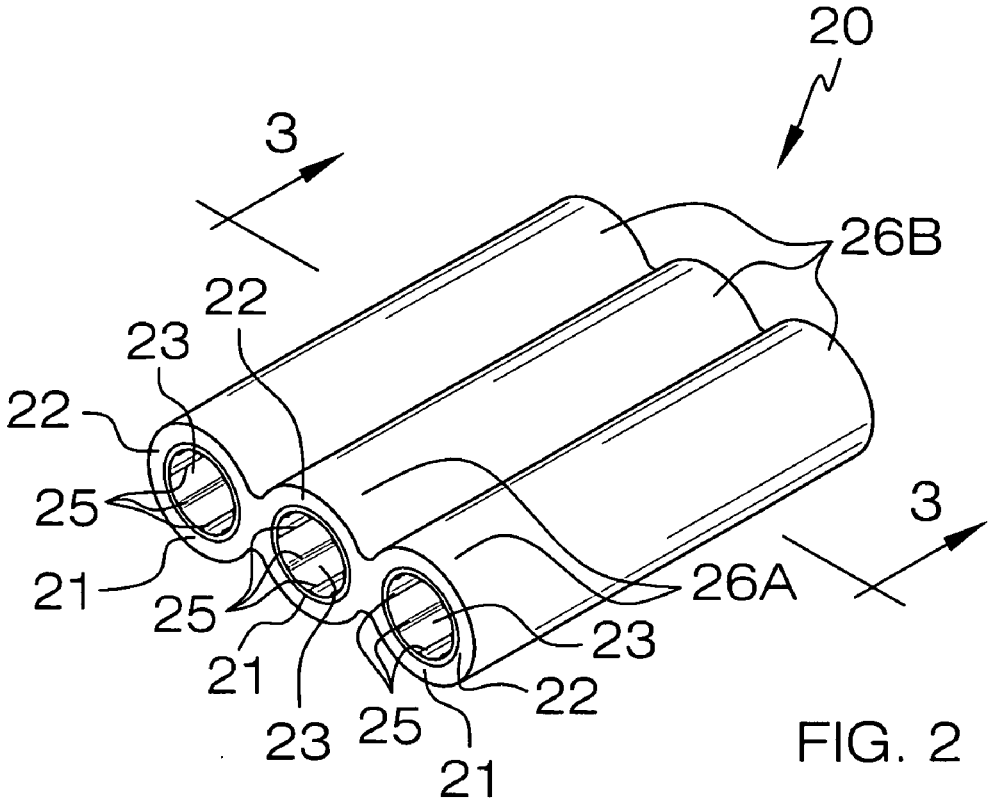
FIG. 2 is a perspective view showing a connector, in accordance with the present invention.
Figure 3:
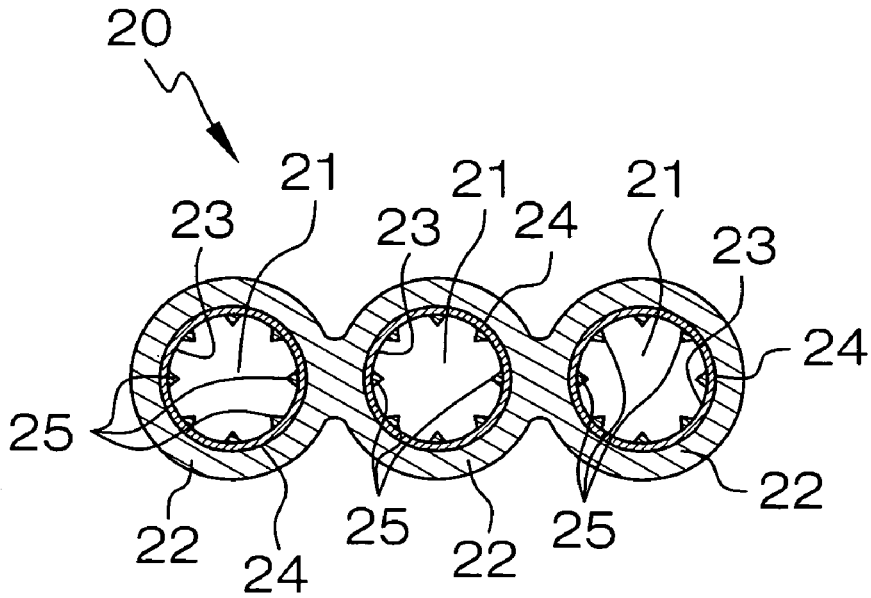
FIG. 3 is a cross-sectional view of the connector shown in FIG. 2, taken along line 3-3.
Figure 4:
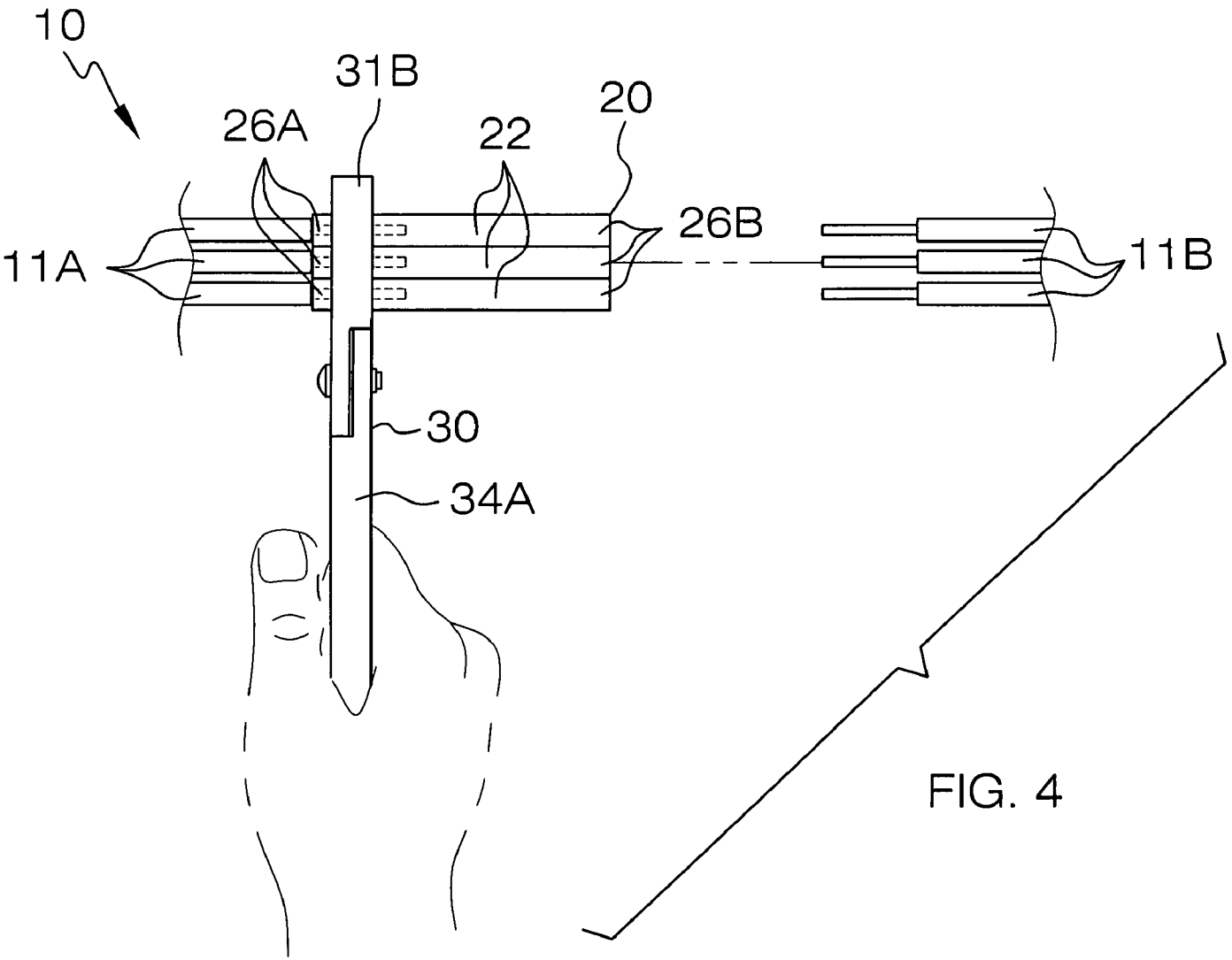
FIG. 4 is a top plan view showing a combined coupling and crimping/splicing tool during operating conditions, in accordance with the present invention.

Referring initially to FIGS. 2, 3 and 4, the apparatus 10 includes a connector 20 including a plurality of coextensively shaped hollow tubular sleeves 21 monolithically formed with each other such that the tubular sleeves 21 remain statically affixed during operating conditions. Of course, the sleeves 21 of the connector 20 may be produced in a variety of alternate lengths and diameters for effectively accommodating different types and sizes of wires 11, as is obvious to a person of ordinary skill in the art. Each of the tubular sleeves 21 has a uniform and continuous outer casing 22 directly coupled, without the use of intervening elements, to an adjacent one of the outer casings 22 in such a manner that the tubular sleeves 21 are registered parallel to each other.

Each of the tubular sleeves 21 further includes a conductive inner casing 23 directly mated, without the use of intervening elements, to an interior surface 24 of a corresponding one of the outer casings 22 respectively. Such inner 23 and outer 22 casings of the sleeves are collapsible, which is crucial for allowing a user to reduce the diameter of the sleeves 21 about the wires 11. Each of the inner casings 23 is provided with a plurality of conductive, sharp knurls 25 radially protruding inwardly towards a center of the tubular sleeves 21 respectively. Such conductive knurls 25 are equidistantly spaced along an inner perimeter of the inner casings 23 and uniformly engage the first 11A and second 11B sets of wires 11 as the first 31A and second 31B jaws (described herein below) are compressed to the closed position.

Figure 5:
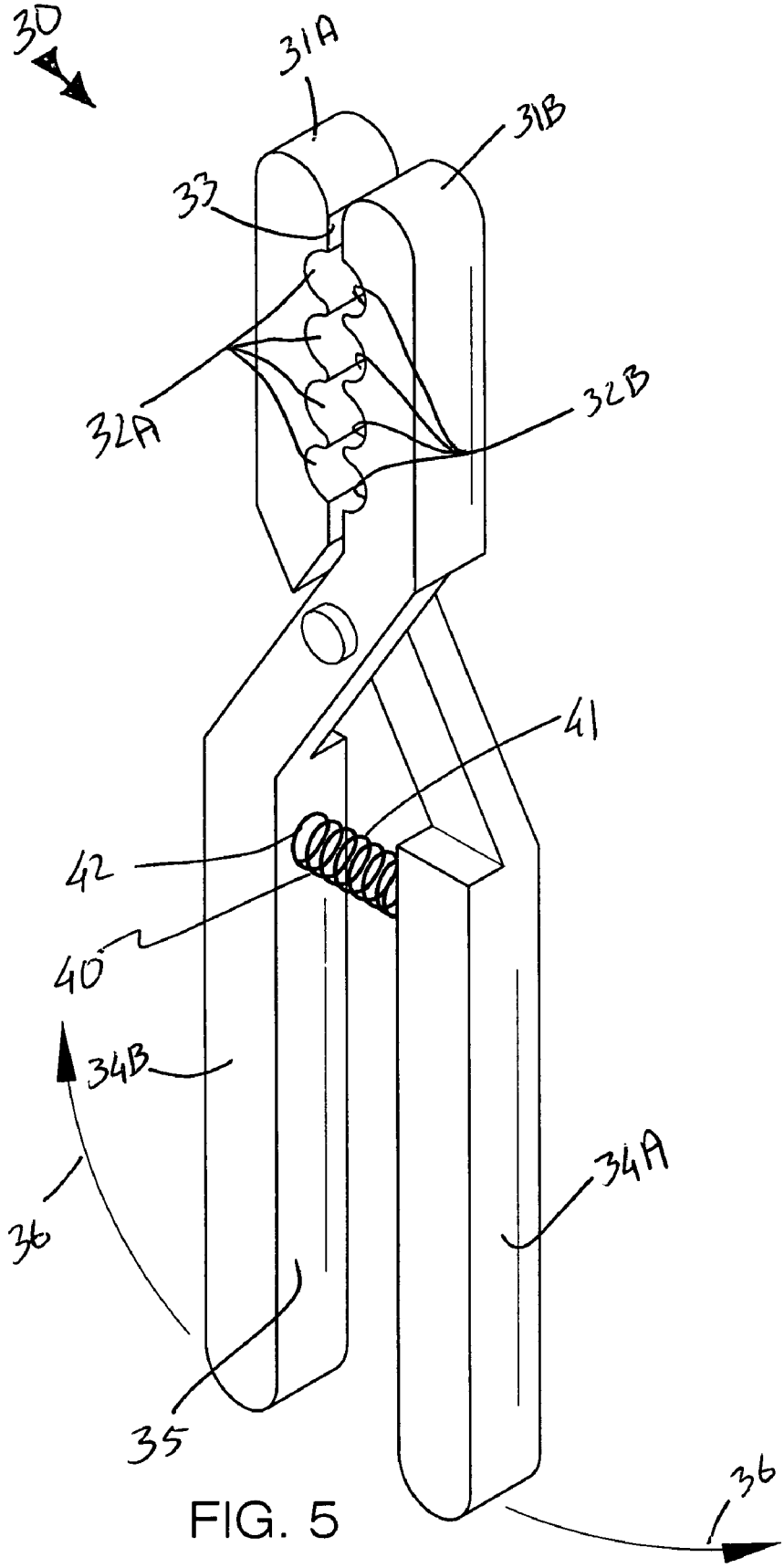
FIG. 5 is a perspective view showing an alternate embodiment of the hand-operated tool shown in FIG. 1, with arrows indicating the movement of each handle during operating conditions.

Referring to FIGS. 1, 4 and 5, a hand-operated tool 30 includes first 31A and second 31B jaws, wherein the first 31A and second 31B jaw members are coextensively shaped. Each of the first 31A and second 31B jaws includes a plurality of blunted arcuate cavities 32 oppositely and equidistantly offset from respective inner edges 33 of the first 31A and second 31B jaws such that a first set 32A of the blunted arcuate cavities 32 faces a corresponding second set 32B of the blunted arcuate cavities 32 in such a manner that each of the outer casings 22 becomes interfitted between the first 32A and second 32B sets of the blunted arcuate cavities when the first 31A and second 31B jaws are pivoted to the closed position, as is best shown in FIG. 2.

Such first 32A and second 32B sets of the blunted arcuate cavities 32 are coextensively shaped. Of course, the first 32A and second 32B sets of cavities may be produced in a variety of sizes and numbers for accommodating differently sized wires 11 and the needs of a user, respectively, as is obvious to a person of ordinary skill in the art. First 34A and second 34B handles are monolithically formed with the first 31A and second 31B jaws, respectively. Such first 34A and second 34B handles are spaced apart when the first 31A and second 31B jaws are directly abutted, without the use of intervening elements, at an engaged position.

Figure 6:
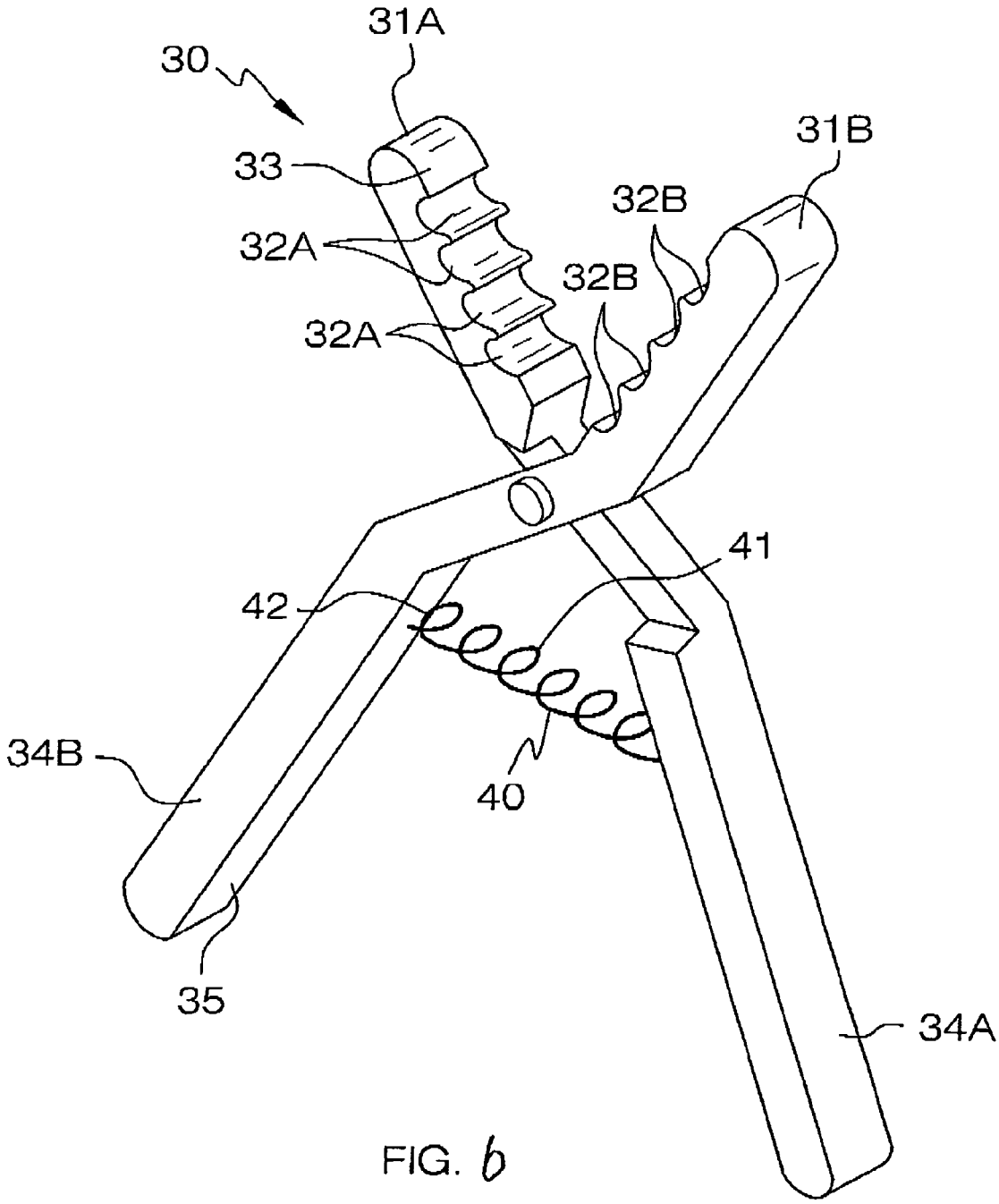
FIG. 6 is a perspective view of the hand-operated tool shown in FIG. 5, wherein the spring member is tensioned to an expanded (extended) position when the handles are pivoted to the open position.

Referring to FIGS. 1 and 5, a mechanism 40 is included for resiliently articulating the first 34A and second 34E handles to an equilibrium position after the first 31A and second 31B jaws are pivoted to an open position. Such a resilient articulating mechanism 40 is important for creating a resistive force opposing a disengaging movement of the first 31A and second 31B jaws. The resilient articulating mechanism 40 includes a single and unitary helical spring member 41 that has axially opposed end portions 42 directly conjoined, without the use of intervening elements, to an interior surface 35 of each of the first 34A and second 34B handles respectively. Such a helical spring member 41 is tensioned to an expanded (extended) position when the first 31A and second 31B jaws are pivoted to the open position, as indicated by the arrows 36 in FIG. 5 and also shown in FIG. 6. The helical spring member 41 returns to equilibrium when the first 31A and second 31B jaws are pivoted to the closed position.

Referring to FIGS. 2 and 4, in use, the connector 20 is statically intercalated directly, without the use of intervening elements, between the first 31A and second 31B jaws when the first 31A and second 31B jaws are pivoted to a closed position such that a first set of wires 11A can be telescopically inserted from a first end 26A of the connector 20 while a second set of wires 11B can be telescopically inserted through a second end 26B of the connector 20 and thereby effectively allow the first 31A and second 31B jaws to crush the sleeves 21 directly about the first 11A and second 11B set of wires such that the conductive knurls 25 bridge a conductive path between the first 11A and second 11B set of wires respectively. Such a connector 20 has a longitudinal length traversing through the first 31A and second 31B jaw members during crimping procedures, as is best shown in FIG. 4.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined connector and crimping/splicing tool for coupling non-metallic sheathed cable, said combined connector and crimping/splicing tool comprising:

a connector including a plurality of coextensively shaped hollow tubular sleeves monolithically formed with each other such that said tubular sleeves remain statically affixed during operating conditions, each of said tubular sleeves having a uniform and continuous outer casing directly coupled to an adjacent one of said outer casings in such a manner that said tubular sleeves are registered parallel to each other, each of said tubular sleeves further including a conductive inner casing directly mated to an interior surface of a corresponding one of said outer casings respectively, each of said inner casings being provided with a plurality of conductive, sharp knurls radially protruding inwardly towards a center of said tubular sleeves respectively, said knurls being equidistantly spaced along an entire inner perimeter of said inner casings respectively, each of said inner perimeters of said inner casings being equidistantly offset from a corresponding center of said tubular sleeves respectively; and a hand-operated tool comprising first and second jaws, first and second handles monolithically formed with said first and second jaws respectively, said first and second jaws being pivoted to a corresponding closed position when said first and second handles are pivoted to a corresponding closed position respectively, said first and second handles remaining spaced apart and maintaining a first linear spatial distance therebetween while situated at the corresponding closed position thereof, said first and second jaws being directly abutted to each other while situated at the corresponding closed position thereof, said first and second handles remaining spaced apart at the first linear spatial distance when said first and second jaws are directly abutted to each other, said first and second handles being spaced apart at a second linear distance therebetween when said first and second jaws are disengaged from each other, wherein said first linear distance is less than said second linear distance, and means for resiliently articulating said first and second handles to the corresponding closed position thereof after said first and second jaws are pivoted to a corresponding open position, said resilient articulating means creating a resistive force opposing a pivotal disengaging movement of said first and second jaws from the corresponding closed position thereof to the corresponding open position thereof, wherein said resilient articulating means comprises a single and unitary helical spring member having axially opposed end portions directly conjoined to an interior surface of each of said first and second handles respectively, said helical spring member being tensioned to an expanded position when said first and second jaws are pivoted to the corresponding open position thereof, said helical spring member returning to equilibrium when said first and second jaws as well as said first and second handles are pivoted to the corresponding closed positions thereof respectively;

wherein said connector is statically intercalated directly between said first and second jaws when said first and second jaws are pivoted to the closed position thereof such that a first set of wires is telescopically inserted from an open first end of said connector while a second set of wires is telescopically inserted through a second open end of said connector, said first and second jaws crushing said sleeves directly about said first and second set of wires such that said conductive knurls bridge a conductive path between said first and second set of wires respectively.

2. The apparatus of claim 1, wherein each of said first and second jaws comprises:

a plurality of blunted arcuate cavities oppositely and equidistantly offset from respective inner edges of said first and second jaws such that a first set of said blunted arcuate cavities faces a corresponding second set of said blunted arcuate cavities in such a manner that each of said outer casings becomes interfitted between said first and second sets of said blunted arcuate cavities when said first and second jaws are pivoted to the corresponding closed position thereof.

3. The apparatus of claim 1, wherein said conductive knurls are equidistantly spaced along an inner perimeter of said inner sleeves and uniformly engage said first and second sets of wires as said first and second jaws are compressed to the corresponding closed position thereof.

4. The apparatus of claim 2, wherein said first and second sets of said blunted arcuate cavities are coextensively shaped.

5. The apparatus of claim 1, wherein said connector has a longitudinal length traversing through said first and second jaw members during crimping procedures.

6. The apparatus of claim 1, wherein said inner and outer casings of said sleeves are collapsible.

* * * * *